United States Patent [19]

Keeffe et al.

[11] Patent Number: 4,890,030

[45] **Date of Patent: * Dec. 26, 1989**

[54] METAL HALIDE DISCHARGE LAMP WITH ARC TUBE TEMPERATURE EQUALIZING MEANS

[75] Inventors: William M. Keeffe, Rockport; Zeya K. Krasko, Danvers, both of Mass.

[73] Assignee: GTE Products Corporation, Danvers, Mass.

[ * ] Notice: The portion of the term of this patent subsequent to Dec. 13, 2005 has been disclaimed.

[21] Appl. No.: 621,648

[22] Filed: Jun. 18, 1984

[51] Int. Cl.[4] ..... H01J 61/34

[52] U.S. Cl. ..... 313/25

[58] Field of Search ..... 313/25, 27, 578–580

[56] References Cited

U.S. PATENT DOCUMENTS

| | | | |
|---|---|---|---|
| 3,234,421 | 2/1966 | Reiling | 313/25 |
| 3,867,661 | 2/1975 | Waltz et al. | 313/27 X |
| 4,281,274 | 7/1981 | Bechard et al. | 313/578 X |
| 4,321,504 | 3/1982 | Keeffe et al. | 313/620 |
| 4,490,649 | 12/1984 | Wang | 313/609 X |
| 4,499,396 | 2/1985 | Fohl et al. | 313/25 |

FOREIGN PATENT DOCUMENTS

| | | |
|---|---|---|
| 852783 | 11/1960 | United Kingdom . |
| 937938 | 2/1961 | United Kingdom . |

*Primary Examiner*—Donald J. Yusko
*Assistant Examiner*—Sandra L. O'Shea
*Attorney, Agent, or Firm*—Joseph S. Ramanow; Thomas H. Buffton; José W. Jimenez

[57] ABSTRACT

A low wattage metal halide discharge lamp includes a arc tube having a temperature equalizing means telescoped thereover and an evacuated outer envelope enclosing the arc tube and convection current reducing means.

8 Claims, 2 Drawing Sheets

METAL HALIDE DISCHARGE LAMP WITH ARC TUBE TEMPERATURE EQUALIZING MEANS

TECHNICAL FIELD

This invention relates to low wattage metal halide discharge lamps and more particularly to a means for equalizing arc tube temperatures in low wattage metal halide discharge lamps.

BACKGROUND ART

Generally, metal halide discharge lamps are of the intermediate or relatively high wattage variety such as about 175 to 1500 watts for example. Also, it is known that the efficacy or the lumen output to input power decreases as the wattage of the lamp decreases. Thus, it has been generally presupposed that at lower wattages, wattages of 100 watts or less, metal halide discharge lamps would be entirely unsatisfactory in so far as efficacy is concerned.

Also, it has been a common practice in the intermediate and relatively high wattage lamps to provide an inert fill gas in the outer envelope in order to prevent oxidation of metal parts of the arc tube mount. Another advantage of an inert gas fill in an outer envelope is a high breakdown voltage which prevents arcing between metal parts of the arc tube mount. However an undesired heat loss due to convection currents of the inert gas in the outer envelope reduces the lamp efficacy significantly.

One known attempt to reduce these undesired heat losses due to convection currents is disclosed in an application filed Aug. 18, 1982 bearing U.S. Ser. No. 409,280 now U.S. Pat. No. 4,499,396 and assigned to the Assignee of the present application. Therein, a quartz envelope is disposed within the gas filled outer envelope of a metal halide discharge lamp in an effort to reduce heat losses due to convection currents.

Another attempt to reduce undesired heat loss due to convection currents is set forth in U.S. Pat. No. 4,281,274. Therein, a glass cylinder surrounds a fuse tube with an outer glass envelope. The outer glass envelope includes one or more lamp filaments and is filled with a gas under pressure. Thus, a glass cylinder and a gas filled outer envelope are employed to reduce the heat loss due to convection currents. However, structures having gas filled envelopes and accompanying convection currents leave something to be desired in reduction of heat loss in so far as relatively high pressure lamps are concerned.

OBJECTS AND SUMMARY OF THE INVENTION

An object of the present invention is to overcome the difficulties of the prior art. Another object of the invention is to provide a low wattage metal halide discharge lamp having reduced heat losses. Still another object of the invention is to provide an improved low wattage metal halide discharge lamp. A further object of the invention is to reduce thermal differences in a low wattage metal halide discharge lamp.

These and other objects, advantages and capabilities are achieved in one aspect of the invention by a low wattage metal halide discharge lamp having a quartz arc tube with a gas fill therein, a temperature equalizing means surrounding the arc tube and an evacuated outer envelope providing a vacuum wherein the arc tube and temperature equalizing means are disposed.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
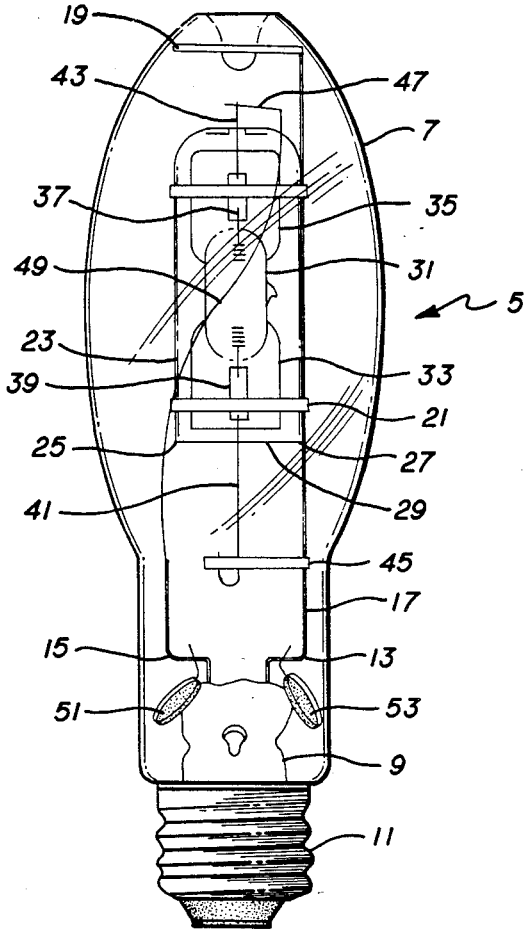
FIG. 1 is a cross-sectional view of one embodiment of a low wattage metal halide discharge lamp of the invention.

Referring to FIG. 1 of the drawings, a low wattage metal halide arc discharge lamp 5 importantly includes an evacuated outer envelope 7. This evacuated outer envelope 7 is hermetically sealed to a glass stem member 9 having an external base member 11 affixed thereto. A pair of electrical conductors 13 and 15 are sealed into and pass through the stem member 9 and provide access for energization of the discharge lamp 5 by an external source (not shown).

Within the vacuum of the evacuated outer envelope 7 a support member 17 is affixed to one of the electrical conductors 13 and extends substantially parallel to the longitudinal axis of the lamp 5 and forms a circular configuration 19 near the upper portion of the envelope 7. This circular configuration 19 in conjunction with the upper portion of the envelope 7 tends to maintain the support member 17 in proper alignment and resistant to deformation caused by external shock.

A first strap member 21 is welded to the support member 17 and extends therefrom in a direction normal to the longitudinal axis and the direction of the support member 17. A domed quartz sleeve or temperature equalizing means 23 has a pair of oppositely disposed notches 25 and 27 on the end thereof 27 opposite to the domed portion. These notches 25 and 27 are formed to slip over the first strap member 21 which serves to support the domed quartz sleeve 23. Also, a substantially circular shaped strap 29 surrounds the domed quartz sleeve 23 near the domed portion thereof and is attached to the support member 17.

Within the temperature equalizing means or domed quartz sleeve 23 is an arc tube 31 having a fill gas including a starting gas, mercury and sodium and scandium metal halides. The arc tube 31 has a pinch seal at opposite ends thereof, 33 and 35 respectively. Metal foil members 37 and 39 are sealed into the press seals 33 and 35 and electrical conductors 41 and 43 are attached to the foil members 37 and 39 and extend outwardly from the press seals 33 and 35. A flexible support member 45 is affixed to one of the electrical conductors 41 and to the support member 17. Also, lead 47 is affixed to the other electrical conductor 43 which passes through the domed portion of the domed quartz sleeve 23. Moreover, a flexible spring-like member 49 connects the lead 47 to the other one 15 of the pair of electrical conductors 13 and 15. A pair of getters 51 and 53 are affixed to the electrical conductors 13 and 15 and serve to provide and maintain the vacuum within the evacuated outer envelope 7 and the domed quartz sleeve 23.

Figure 2:
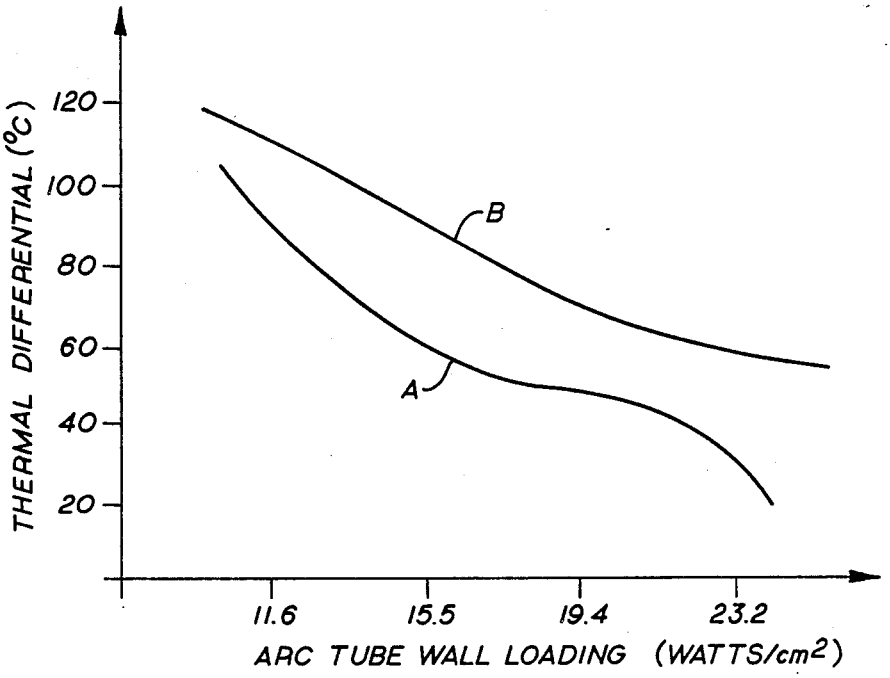
FIG. 2 is a chart comprising the thermal differential or hot spot minus cold spot temperatures of the prior art and of the lamp of the present invention.

Referring to the comparison chart of FIG. 2, it can readily be seen that the thermal differential or the difference in temperature between the hot and cold spots of a discharge tube vary in accordance with the wall loading, in watts/cm$^2$, of the arc tube. Importantly, it can readily be seen that this temperature differential is less for a metal halide discharge lamp having an evacuated outer envelope (Curve A) as compared with a discharge lamp having a gas filled outer envelope (Curve B). In both instances the discharge lamps were low wattage, 100-watt, metal halide discharge lamps having a domed quartz envelope surrounding an arc tube having a gas fill therein. However, the lamps having the gas filled outer envelope (Curve B) had an increased temperature differential value. Specifically, a low wattage metal halide discharge lamp having an evacuated outer envelope and a wall loading of about 15.5 w/cm$^2$ has a thermal differential temperature of about 60° C. while the same structure having a gas filled outer envelope has differential temperature of about 90° C. Accordingly, it can readily be seen that the evacuated outer envelope combined with a domed quartz sleeve provide an enhanced low wattage metal halide discharge lamp having reduced thermal differences between the hot and cold spots of the discharge tube.

While there has been shown and described what is at present the preferred embodiments of the invention, it will be obvious to those skilled in the art that various changes and modifications may be made therein without departing from the invention as defined by the appended claims.

We claim:

1. A metal halide arc discharge lamp comprising:

(a) a hermetically sealed outer envelope;

(b) an arc tube mounted within said outer envelope, said arc tube having a body and at least one end, said body enclosing an interior containing a gaseous fill and a metal halide additive therein, said body having a predetermined wall loading and during operation of said lamp having a point of highest temperature and a point of lowest temperature, the difference between said highest and lowest temperatures being less than approximately 93 degrees Centigrade when said predetermined wall loading is at least 11.6 watts per square centimeter;

(c) a light-transmissive enclosure mounted within said outer envelope, said enclosure surrounding said arc tube laterally and about at least one end;

(d) a vacuum within said outer envelope;

(e) means for mounting said arc tube and said light-transmissive enclosure; and (f) means for structurally and electrically completing said lamp.

2. A lamp as described in claim 1 wherein said difference between said highest and lowest temperatures is less than approximately 60 degrees Centigrade when said predetermined wall loading is at least 15.5 watts per square centimeter.

3. A lamp as described in claim 2 wherein said difference between said highest and lowest temperatures is less than approximately 44 degrees Centigrade when said predetermined wall loading is at least 19.4 watts per square centimeter.

4. A lamp as described in claim 1 wherein said metal halide additive includes sodium.

5. A lamp as described in claim 2 wherein said metal halide additive further includes scandium.

6. A lamp as described in claim 1 wherein said arc tube is double-ended.

7. A lamp as described in claim 1 wherein said light-transmissive envelope is a cylinder having a dome on one end thereof.

8. A lamp as described in claim 1 wherein said lamp has a rated wattage of 150 watts or less.

* * * * *